US010193275B2

(12) United States Patent
Matsui et al.

(10) Patent No.: US 10,193,275 B2
(45) Date of Patent: Jan. 29, 2019

(54) ELECTRICAL CONNECTION DEVICE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Yasuo Omori, Mie (JP); Tetsuya Miyamura, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/765,727

(22) PCT Filed: Oct. 3, 2016

(86) PCT No.: PCT/JP2016/079215
§ 371 (c)(1),
(2) Date: Apr. 4, 2018

(87) PCT Pub. No.: WO2017/061352
PCT Pub. Date: Apr. 13, 2017

(65) Prior Publication Data

US 2018/0287300 A1 Oct. 4, 2018

(30) Foreign Application Priority Data

Oct. 7, 2015 (JP) ..... 2015-199167

(51) Int. Cl.
*H01R 13/631* (2006.01)
*H01R 12/70* (2011.01)
(Continued)

(52) U.S. Cl.
CPC ..... *H01R 13/631* (2013.01); *H01R 12/7005* (2013.01); *H01R 43/26* (2013.01); *H01R 13/516* (2013.01)

(58) Field of Classification Search
CPC ..... H01R 13/631; H01R 13/516; H01R 12/7005; H01R 43/26; H01R 13/629; H01R 13/62911
(Continued)

(56) References Cited

U.S. PATENT DOCUMENTS 5,478,251 A * 12/1995 Jaklin ..... H01R 13/6275 439/157
5,876,226 A * 3/1999 Tsukakoshi ..... H01R 13/62922 439/157
(Continued)

FOREIGN PATENT DOCUMENTS

JP 2000-243512 9/2000
JP 2001-351729 12/2001
(Continued)

OTHER PUBLICATIONS

International Search Report dated Dec. 27, 2016.

*Primary Examiner* — Harshad C Patel
(74) *Attorney, Agent, or Firm* — Gerald E. Hespos; Michael J. Porco; Matthew T. Hespos

(57) ABSTRACT

An electrical connection device includes a connector unit (2) having first connectors aligned in an arrangement direction, second connectors and a connecting tool (30). The connecting tool (30) detachably holds the second connectors in an alignment corresponding to that of the first connectors. One of the connector unit (2) and the connecting tool (30) includes a guided portion (5), and the other includes a guiding portion (50). The guiding portion (50) includes a receiving portion for receiving the guided portion (5) in a receiving direction, a connection guiding portion for guiding
(Continued)

the guided portion (5) to displace the connector unit (2) and the connecting tool (30) in a connector connecting direction as the connector connecting tool (30) is operated with respect to the connector unit (2) in the arrangement direction, and a separation allowing portion for allowing separation of the guided portion (5) from the connection guiding portion.

7 Claims, 25 Drawing Sheets

(51) Int. Cl.
*H01R 43/26* (2006.01)
*H01R 13/516* (2006.01)

(58) Field of Classification Search
USPC ..... 439/374, 157, 347
See application file for complete search history.

(56) References Cited

U.S. PATENT DOCUMENTS

| | | | | |
|---|---|---|---|---|
| 6,155,850 | A * | 12/2000 | Martin | H01R 13/62911 439/157 |
| 6,183,279 | B1 | 2/2001 | Murakami et al. | |
| 6,254,407 | B1 * | 7/2001 | Burns | H01R 13/62905 439/157 |
| 7,097,476 | B2 * | 8/2006 | Morikawa | H01R 13/62911 439/157 |
| 2014/0045358 | A1 | 2/2014 | Oshita et al. | |

FOREIGN PATENT DOCUMENTS

| | | |
|---|---|---|
| JP | 2011-165375 | 8/2011 |
| JP | 2012-195088 | 10/2012 |

* cited by examiner

ELECTRICAL CONNECTION DEVICE

BACKGROUND

Field of the Invention

The invention relates to an electrical connection device for forming electrical connection by connecting a plurality of first connectors included in a connector unit such as a junction box and a plurality of second connectors.

Description of the Related Art

Japanese Unexamined Patent Publication No. 2001-351729 and Japanese Unexamined Patent Publication No. 2011-165375 each disclose an electrical connection device with a pair of connectors for electrical connection by being connected to each other.

A device described in Japanese Unexamined Patent Publication No. 2001-351729 includes a male connector and first and second connectors that are connectable to this male connector. Each of the first and second connectors is provided with a lever for a connecting operation. Thus, each of the first and second connectors is connected to the male connector merely by rotating each lever with a relatively small force.

A device described in Japanese Unexamined Patent Publication No. 2011-165375 includes a plurality of first connectors, a plurality of split housings, a holder for holding the split housings, and a connector connecting tool. The connector connecting tool collectively connects the connector terminals held by first connector housings and second connector terminals held by the respective split housings by pulling the connector housings and the holder toward each other. The connector connecting tool is mountable to the first connectors at a predetermined mounting position and can be separated from this mounting position in an arrangement direction of the split housings. Guided portions project from the holder, and the connector connecting tool is formed with guiding grooves for guiding the respective guided portions. Each guiding groove is shaped to guide the guided portion so that the connection of the connectors proceeds as the connector connecting tool is separated from the mounting position.

However, in the device described in Japanese Unexamined Patent Publication No. 2001-351729, a special force multiplying mechanism, such as a lever must be attached to the connector to reduce an operation force for connecting the connectors. This inconvenience becomes more notable as the number of the connectors increases. There is also an inconvenience that the connecting operation has to be performed for each connector.

In the device described in Japanese Unexamined Patent Publication No. 2011-165375, the split housings can be connected collectively to the first connector housings with a small operation force. However, the device requires the connector connecting tool, and also the holder to be guided in a connecting direction by the connector connecting tool while holding the split housings. Thus, an increase in the number of components is unavoidable. Further, the connector connecting tool can be separated from the first connector housings after the completion of the connecting operation. However, the holder remains while being interposed between the connectors. Thus, the device is larger and heavier due to this holder even after the connector connection is finished.

The invention aims to provide an electrical connection device having a small number of components and capable of collectively connecting a plurality of first connectors and a plurality of second connectors with a small operation force.

SUMMARY

An electrical connection device provided by the invention includes a connector unit including first connectors that are aligned along a specific arrangement direction. Second connectors respectively are connectable to the first connectors in a connector connecting direction perpendicular to the arrangement direction, and a connector connecting tool is provided for connecting the respective first connectors and the respective second connectors. The connector connecting tool detachably holds the second connectors in an alignment corresponding to that of the plurality of first connectors so that the first connectors and the second connectors are connectable. One of the connector unit and the connector connecting tool includes a guided portion, and the other includes a guiding portion for guiding the guided portion while being engaged with the guided portion. The guiding portion includes a receiving portion for enabling the engagement of the connector unit and the connector connecting tool by receiving the guided portion in a receiving direction having a component of a direction parallel to the connector connecting direction. The connection device further includes a connection guiding portion for allowing the connector connecting tool to be operated in a tool operating direction that is parallel to the arrangement direction with respect to the connector unit with the guided portion received in the receiving portion. The connection guiding portion guides the guided portion in a connection guiding direction that is inclined toward the connector connecting direction with respect to a direction parallel to the tool operating direction. Thus, the connector connecting tool is displaced in the connector connecting direction with respect to the connector unit with a force larger than an operation force received by the connector connecting tool as the connector connecting tool is operated. The connection device further includes a separation allowing portion for releasing the guided portion in a separating direction having a component of a direction opposite to the receiving direction to allow the guided portion to be separated from the connection guiding portion in the separating direction after the connection.

DETAILED DESCRIPTION

Figure 1:
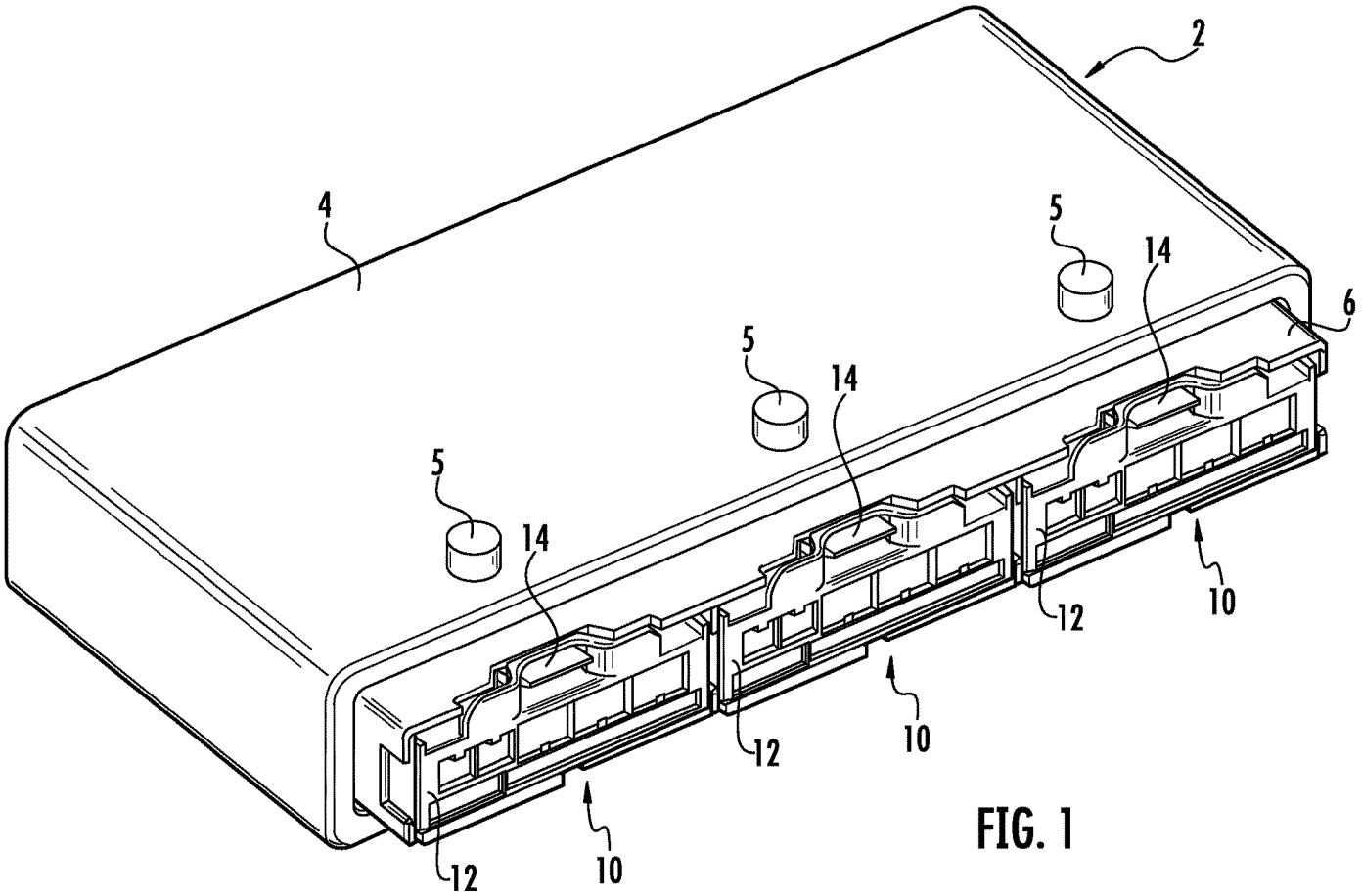
FIG. 1 is a perspective view showing a connector unit of an electrical connection device according to an embodiment of the present invention.
Figure 2:
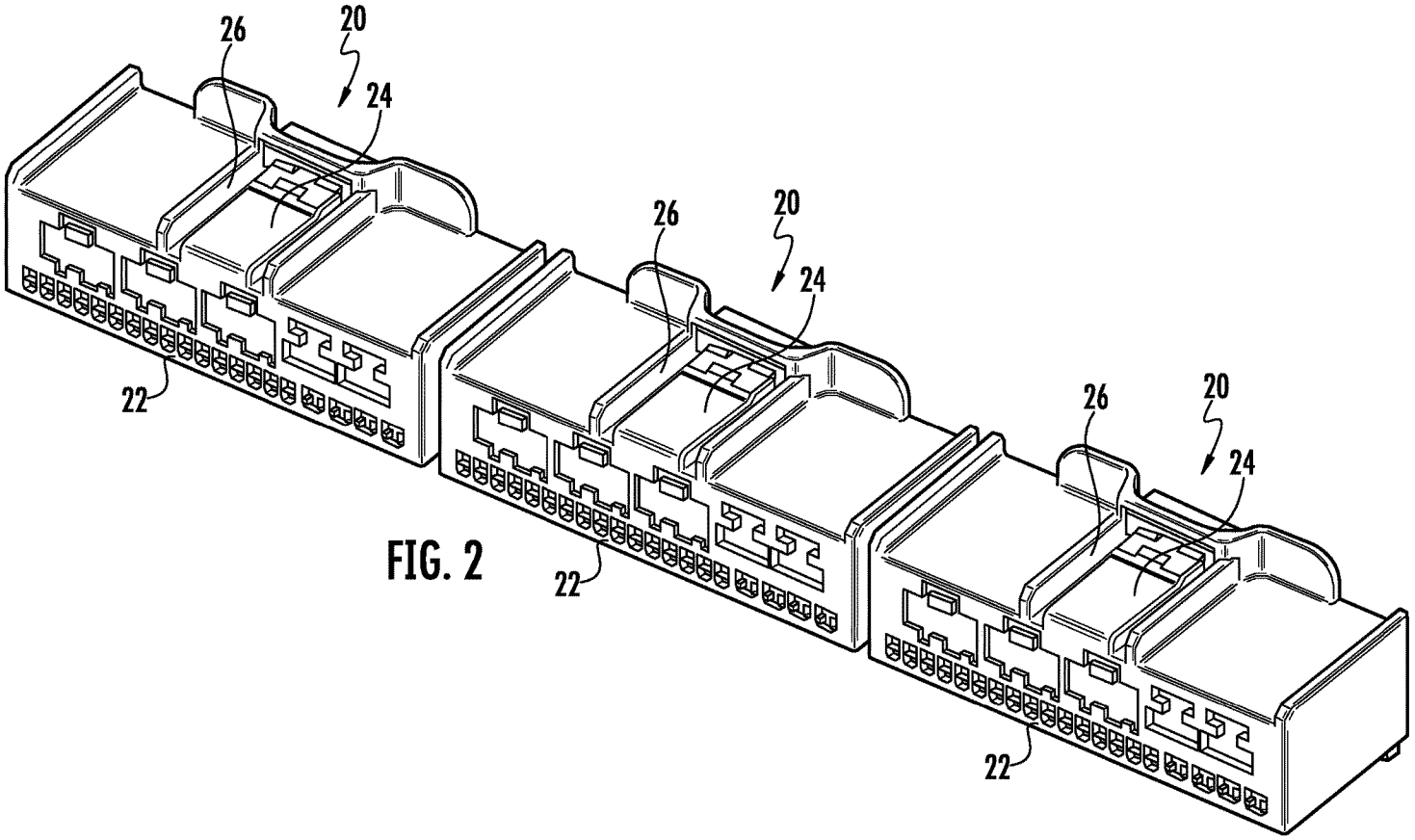
FIG. 2 is a perspective view showing a state where second connectors of the electrical connection device are aligned in an arrangement direction.
Figure 3:
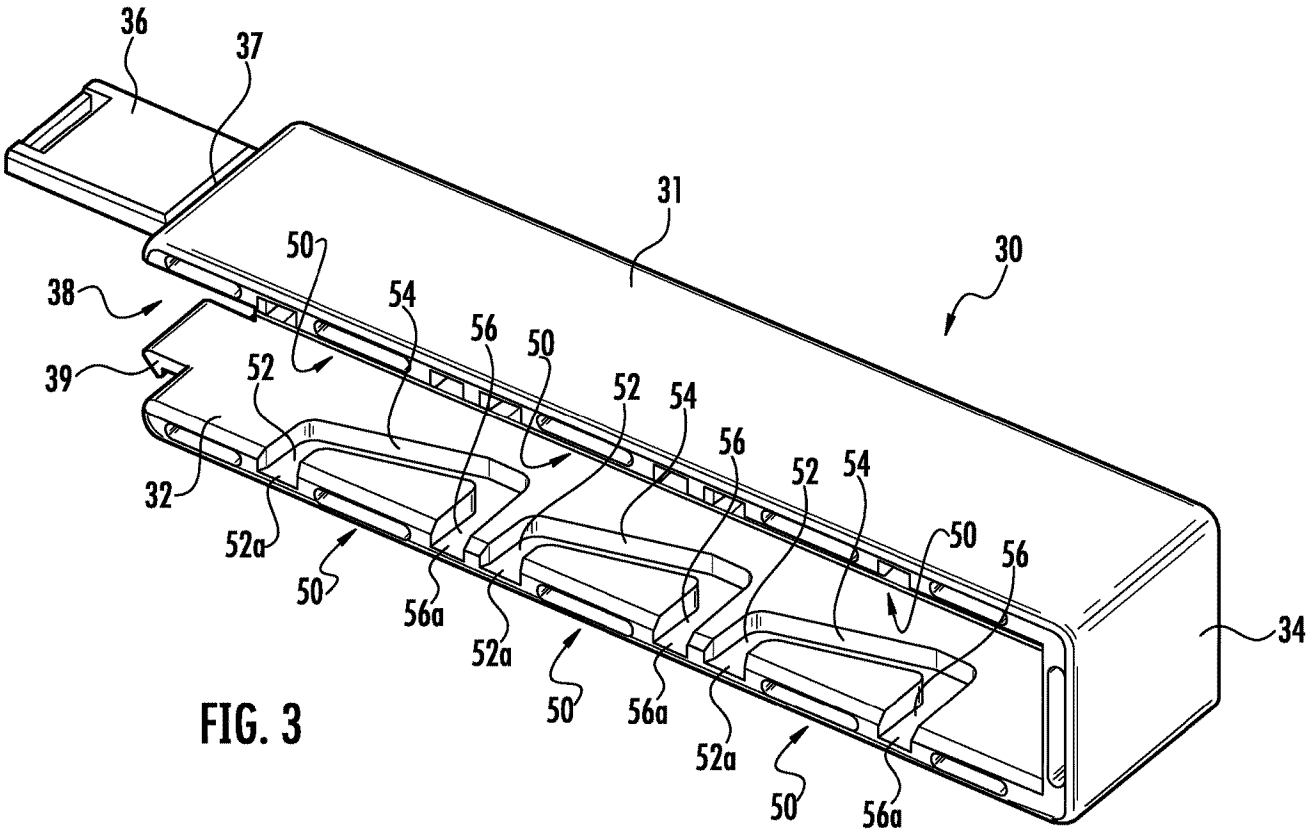
FIG. 3 is a perspective view of a connector connecting tool of the electrical connection device.

A preferred embodiment of the present invention is described with reference to the drawings. An electrical connection device according to this embodiment includes a connector unit 2 with first connectors 10, as shown in FIG. 1. The electrical connection device further includes second connectors 20, as shown in FIG. 2 that are respectively connectable to the respective first connectors 10, and a connector connecting tool 30 shown in FIGS. 3 to 11 that is used to realize the connection. The connector unit 2 is, for example, a junction box installed in an automotive vehicle and each second connector 20 is a harness connector provided at an end of a wiring harness installed in the automotive vehicle. However, a specific application of the first and second connectors is not limited in the present invention.

The connector unit 2 according to this embodiment includes the first connectors 10 and a case 4, as shown in FIG. 1. The case 4 holds the first connectors 10 with the first connectors 10 aligned in a predetermined arrangement direction (lateral direction in FIG. 1) perpendicular to a connector connecting direction. Further, the case 4 includes a receptacle 6 for collectively surrounding the first connectors 10 aligned in the arrangement direction.

Each of the first connectors 10 includes unillustrated first connector terminals and a first connector housing 12 for holding the first connector terminals. The first connectors 10 are aligned such that the first connector housings 12 thereof are adjacent in the arrangement direction with almost no gap formed therebetween. Further, each first connector housing 12 is formed with a connection lock 14.

A specific structure of the connector unit and a specific arrangement of the first connectors according to the invention are not limited. For example, the first connector housings 12 of the first connectors 10 and the case 4 may be integrally molded of synthetic resin or the first connector housings 12 of the first connectors 10 may be integrally molded to each other and the case 4 may be omitted. Further, a specific number of the first connectors and a specific number of the second connectors corresponding to the first connectors also are not limited.

Each of the second connectors 20 includes unillustrated second connector terminals and a second connector housing 22 for holding the second connector terminals. Each second connector terminal can be mated with the corresponding one of the first connector terminals in the connector connecting direction, and the connector connecting direction is parallel to axial directions of the first and second connector terminals. Further, each second connector housing 22 can be connected to the first connector housing 12 of the corresponding first connector 10 in the connector connecting direction.

Each second connector housing 22 includes an upper protrusion 26 including a connection lock portion 24 and a lower protrusion 28 shown in FIGS. 8 to 11. The connector lock 24 is engaged with the connector lock 14 of the first connector housing 12 with the first and second connectors 10, 20 connected to each other, thereby locking a connected state of the first and second connectors 10, 20. The upper and lower protrusions 26, 28 respectively project up and down from the upper and lower surfaces of a body part of the second connector housing 22 and function as restrained portions to be restrained by the connector connecting tool 30.

The connector connecting tool 30 detachably holds the second connectors 20 in an alignment (alignment in which the second connectors 20 are arranged in the arrangement direction) corresponding to that of the first connectors 10 so that the first connectors 10 and the second connectors 20 are connectable, and realizes the connection with a small operation force by being operated to move with respect to the connector unit 2 in a tool operating direction parallel to the arrangement direction.

The connector connecting tool 30 according to this embodiment is integrally molded of synthetic resin and is shaped to receive the second connectors 20 inserted into the connector connecting tool 30 along a direction parallel to the arrangement direction. Specifically, the connector connecting tool 30 includes two main walls 31, 32, a back wall 33, an end wall 34 and a lid 36.

The main walls 31, 32 extend in a direction parallel to the arrangement direction and the tool operating direction while being located on both sides across the second connectors 20 in a separating direction (vertical direction in figures) perpendicular to both the connector connecting direction and the tool operating direction.

Figure 4:
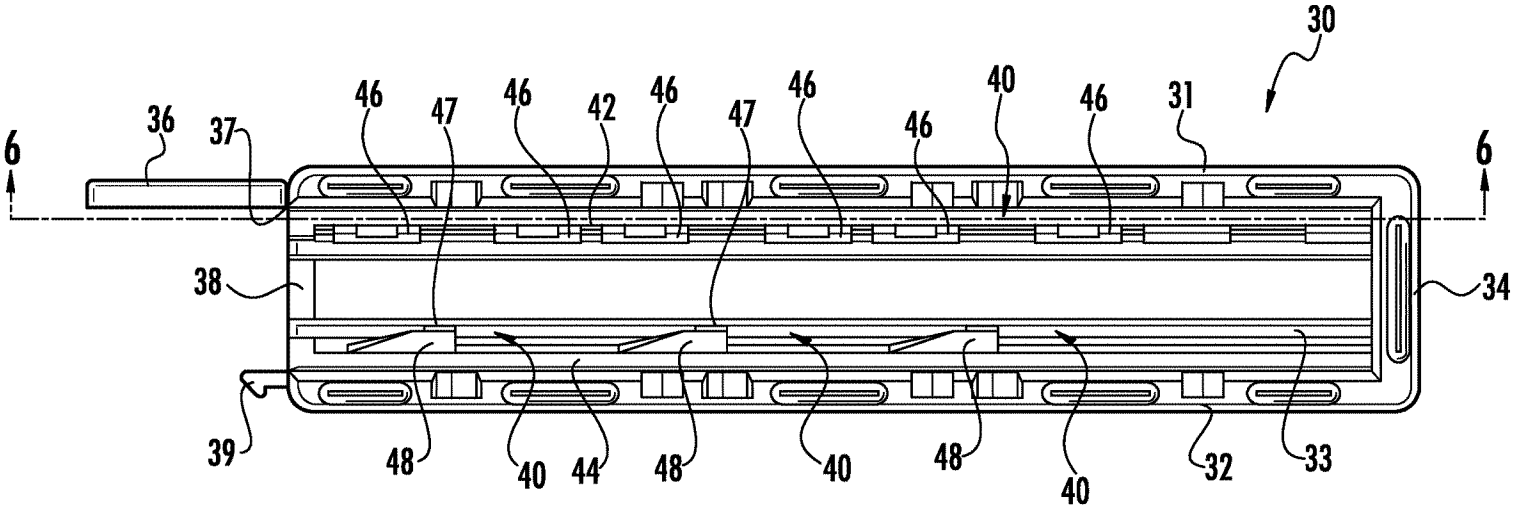
FIG. 4 is a front view of the connector connecting tool.
Figure 5:
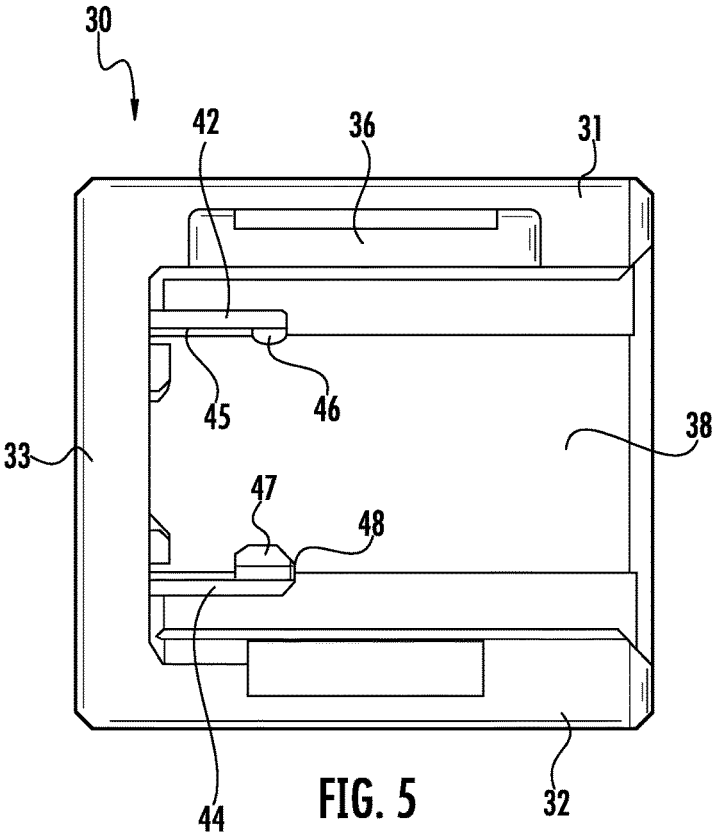
FIG. 5 is a side view of the connector connecting tool viewed from a connector insertion opening side.

The back wall 33 and the end wall 34 constitute a coupling wall that couples both end parts of the main walls 31, 32 in a width direction (direction perpendicular to a longitudinal direction) excluding right end parts in FIG. 5 and both end parts in the arrangement direction excluding left end parts of FIG. 4. Specifically, the back wall 33 is connected to the main walls 31, 32 to couple the left end parts in FIG. 5 located on a side opposite to the connector unit 2, and the end wall 34 is connected to the main walls 31, 32 to couple the right end parts of FIG. 4.

A connector insertion opening 38 for receiving the second connectors 20 is formed between the left end parts of FIG. 4 on a side opposite to the end wall 34. Specifically, the connector connecting tool 30 according to this embodiment is shaped to be able to receive the second connectors 20 successively inserted therein in the direction parallel to the arrangement direction through the connector insertion opening 38.

The lid 36 is displaced to open and close the connector insertion opening 38. The lid 36 according to this embodiment is connected to the end part of the upper main wall 31 via a thin hinge 37 and rotates between a closing position for closing the connector insertion opening 38 and an opening position for opening the connector insertion opening 38 with the hinge 37 as a support while the hinge 37 is deformed resiliently. Further, a locking portion 39 for locking the lid 36 at the closing position is provided on the lower main wall 32. This lid 36 can be omitted as appropriate.

In the connector connecting tool 30 according to this embodiment, the two main walls 31, 32 can be deformed resiliently to allow displacements in directions away from each other, i.e. up and down. The resilient deformation of the main walls 31, 32 facilitates the insertion of each second connector 20 between the main walls 31, 32, as described later.

In the connector connecting tool 30 according to this embodiment, connector restraining positions 40 aligned in parallel to the arrangement direction are set, and a connector restraining portion for restraining each second connector 20 is given to each of the connector restraining positions 40. The connector restraining position includes upper and lower deflection pieces 42, 44 projecting in from the back wall 33 and projecting inward, first upper restraining portions 45 and second upper restraining portions 46 formed on a tip part of the upper deflection piece 42 and lower restraining portions 48 formed on a tip part of the lower deflection piece 44.

Each of the upper and lower deflection pieces 42, 44 extends over the entire area of the back wall 33 along the arrangement direction. The tip parts, i.e. end parts distant from the back wall 33, of the upper and lower deflection pieces 42, 44 can be displaced resiliently in the vertical direction.

The first and second upper restraining portions 45, 46 are formed at intervals in a longitudinal direction of the upper deflection piece 42 such that left and right first upper restraining portions 45 and left and right second upper restraining portion 46 are assigned to each connector restraining position 40. That is, in this embodiment, two each of a total of six first upper restraining portions 45 and a total of six second upper restraining portions 46 are assigned to each of three connector restraining positions 40.

Figure 8:
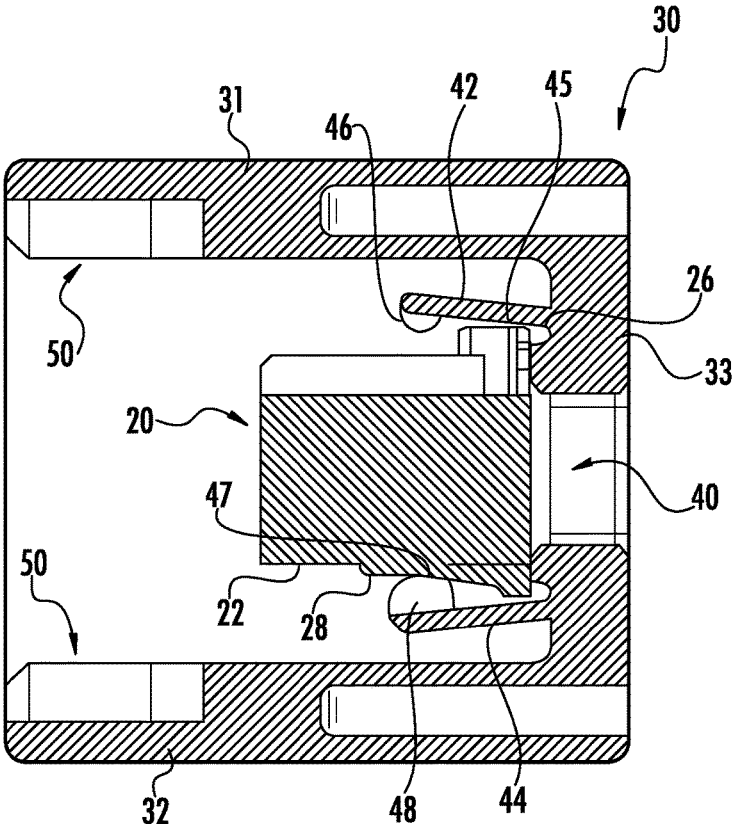
FIG. 8 is a side view in section along VIII-VIII of FIG. 7.
Figure 9:
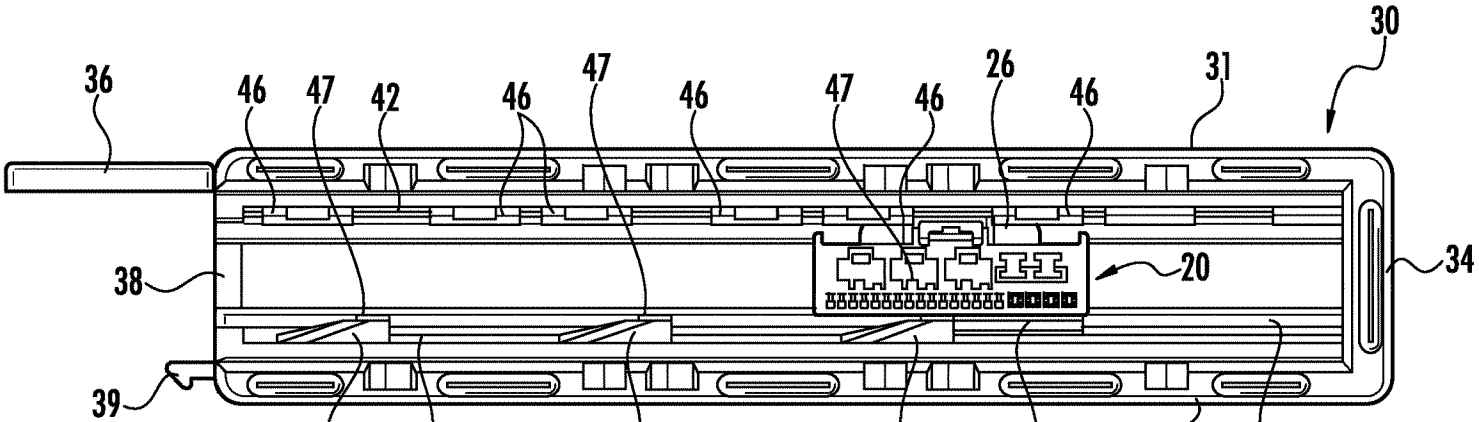
FIG. 9 is a front view showing a stage where the insertion of the first second connector is completed.
Figure 10:
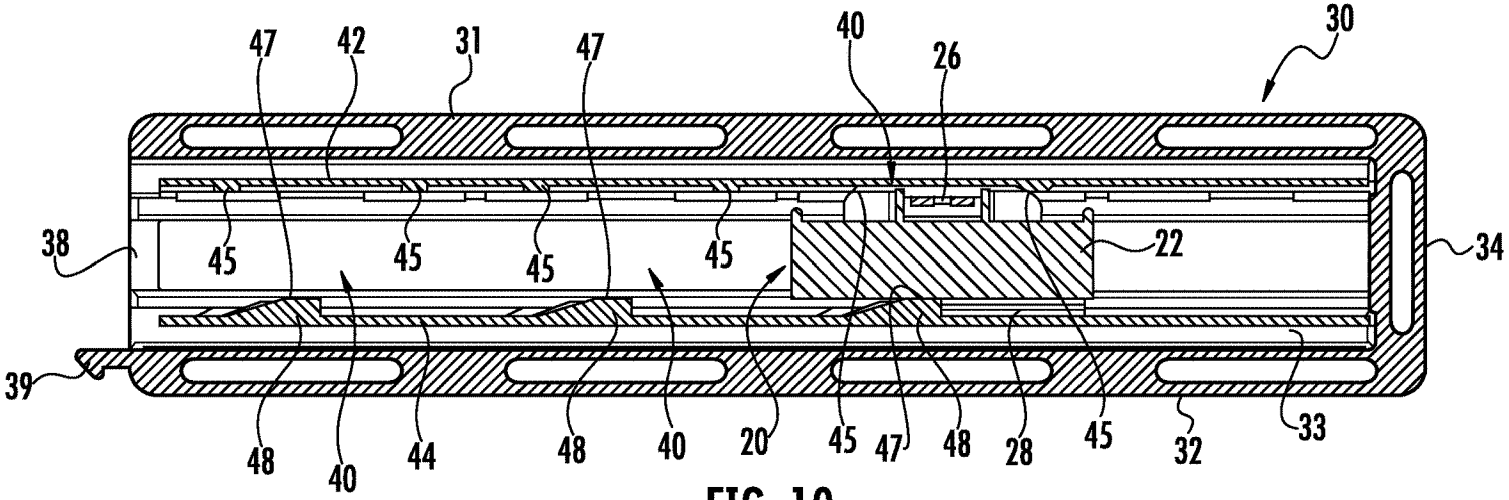
FIG. 10 is a front view in section showing the stage shown in FIG. 9.
Figure 11:
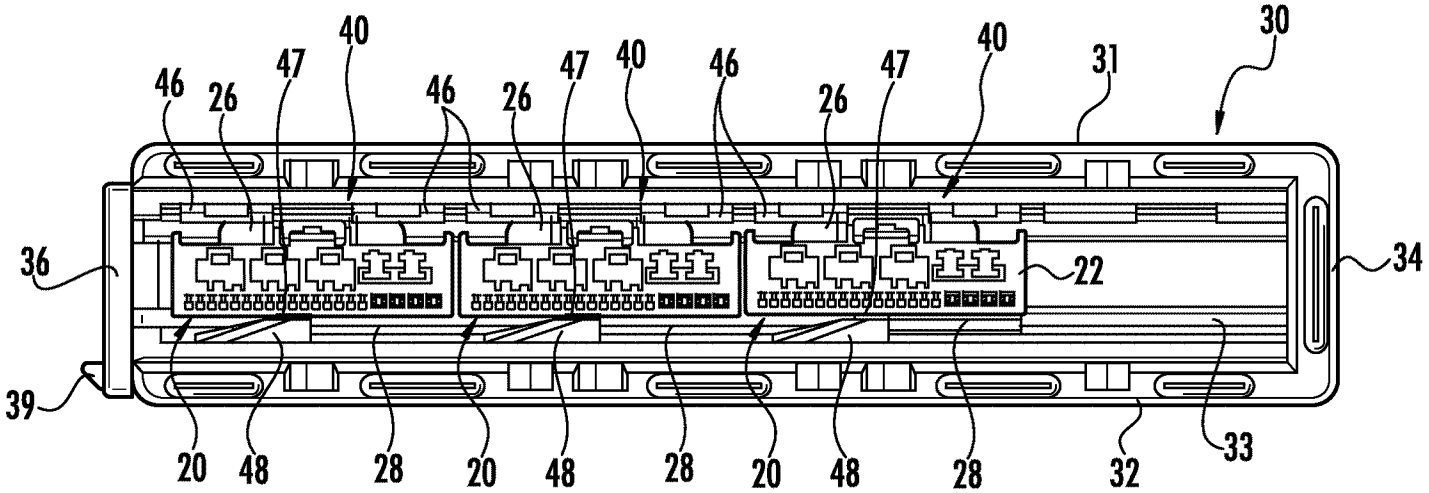
FIG. 11 is a front view showing a state where the insertion of all the second connectors into the connector connecting tool is completed.

As shown in FIGS. 5 and 8, each first upper restraining portion 45 projects down on a part near the base end of the upper deflection piece 42 and is held at a restraining position for restraining the second connector 20 that has reached the connector restraining position 40 from both sides in the arrangement direction, as shown in FIG. 11, in a state where the upper deflection piece 42 is not deformed. Each second upper restraining portion 46 projects down from the tip part of the upper deflection piece 42 and is held at a restraining position for restraining the upper protrusion 26 of the second connector 20 from a side opposite to the back wall 33 (i.e. from the side of the first connector 10) for impeding a movement of the second connector 20 in a direction away from the back wall 33 in the state where the upper deflection piece 42 is not deformed. Both the first and second upper restraining portions 45, 46 can be displaced resiliently up from the restraining position by upward deflection of the upper deflection piece 42 and reach a releasing position, i.e. a position where the upper protrusion 26 is released.

The lower restraining portions 48 are formed at intervals in a longitudinal direction of the lower deflection piece 44 such that one lower restraining portion 45 is assigned to each connector restraining position 40. Each lower restraining portion 48 projects up from the tip part of the lower deflection piece 44 and is held at a restraining position for restraining the lower protrusion 28 of the second connector 20 from a side opposite to the connector insertion opening 38 (i.e. from the side of the end wall 34) for impeding a movement of the second connector 20 returning toward the connector insertion opening 38 in a state where the lower deflection piece 44 is not deformed and can be displaced resiliently down by downward deflection of the lower deflection piece 44 to reach a releasing position where the lower protrusion 28 is released. Further, a gently curved surface is formed on an upper surface 47 of the lower restraining portion 48 and is inclined in a direction to be elevated with distance from the connector insertion opening 38 to facilitate a movement of the lower protrusion 28 over the lower restraining portion 48 when the second connector 20 is inserted.

The connector unit 2 includes guided protrusions 5 and the connector connecting tool 30 includes guiding grooves 50 for guiding the guided protrusions 5 while being engaged with the respective guided protrusions 5.

The guided protrusions 5 project up and down in directions perpendicular to the connector connecting direction and the tool operating direction from edge parts of upper and lower walls of the case 4 of the connector unit 2 on a side near the second connectors 20 held by the connector connecting tool 30. The respective guided protrusions 5 are provided at intervals in a direction along the edge parts and hence are spaced in a direction parallel to the arrangement direction and the tool operating direction. Each guided protrusion 5 may be shaped to fit into and guidable by the guiding groove 50. Each guided protrusion 5 has a cylindrical shape having a center axis in a projecting direction thereof.

The guiding grooves 50 are formed at positions corresponding to the respective guided protrusions 5 on inner side surfaces of the main walls 31, 32 of the connector connecting tool 30. That is, the guiding grooves 50 are formed positions aligned at intervals in a direction along the edge parts (i.e. direction parallel to the arrangement direction and the tool operating direction) on the edge parts near the connector unit 2 out of both edge parts of the main walls 31, 32 in the width direction.

Each guiding groove 50 is shaped to be able to receive the guided protrusion 5 fit therein, and specifically has a width slightly larger than a diameter of the guided protrusion 5. More specifically, each guiding groove 50 includes a receiving groove 52, a connection guiding groove 54 and a separation allowing groove 56 and is shaped such that these grooves 52, 54 and 56 are arranged successively in this order.

Figure 15:
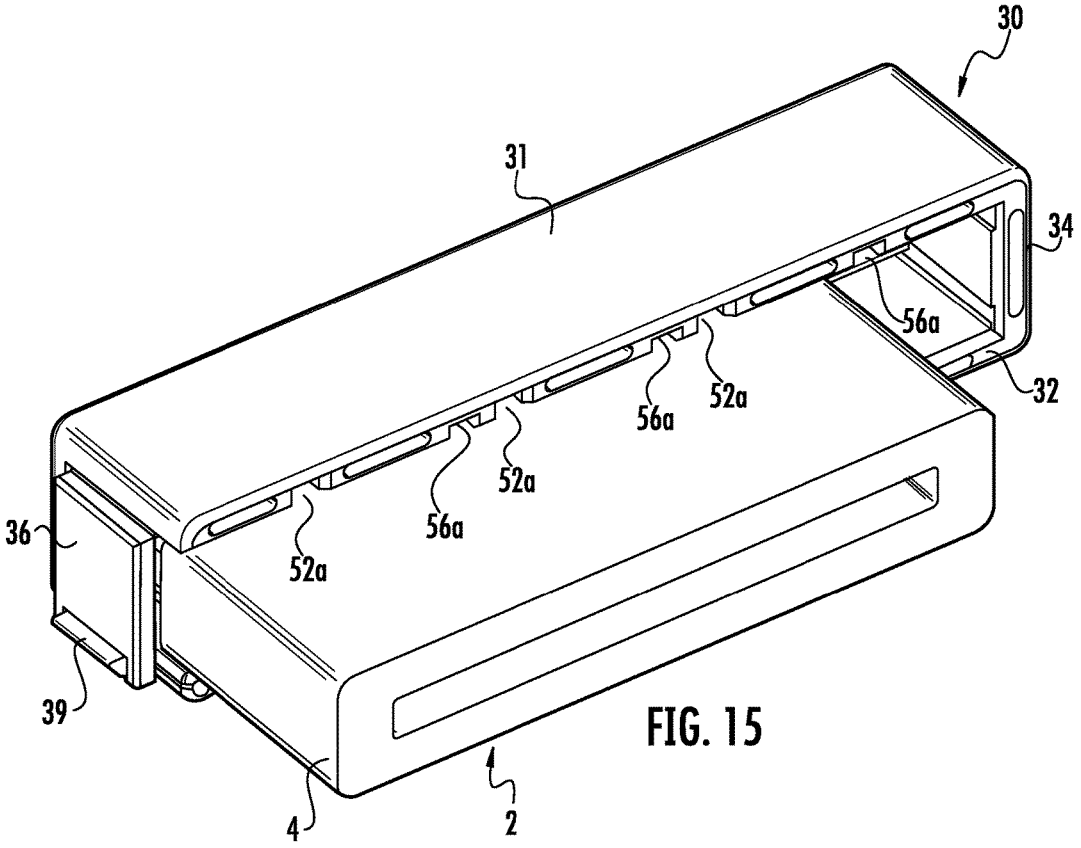
FIG. 15 is a perspective view showing a reception end stage, which is a stage where the insertion of the guided protrusions into receiving grooves in the guiding grooves is completed.
Figure 16:
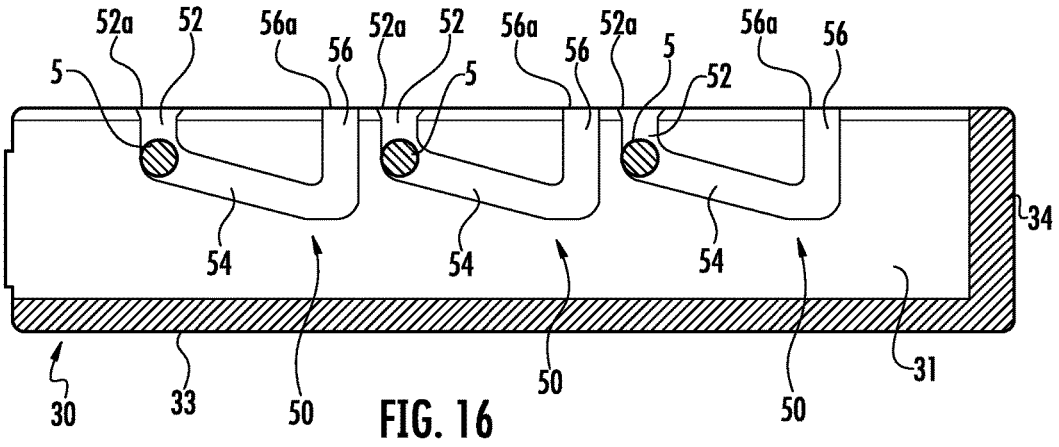
FIG. 16 is a bottom view in section showing the upper main wall of the connector connecting tool viewed from below in the reception end stage.
Figure 17:
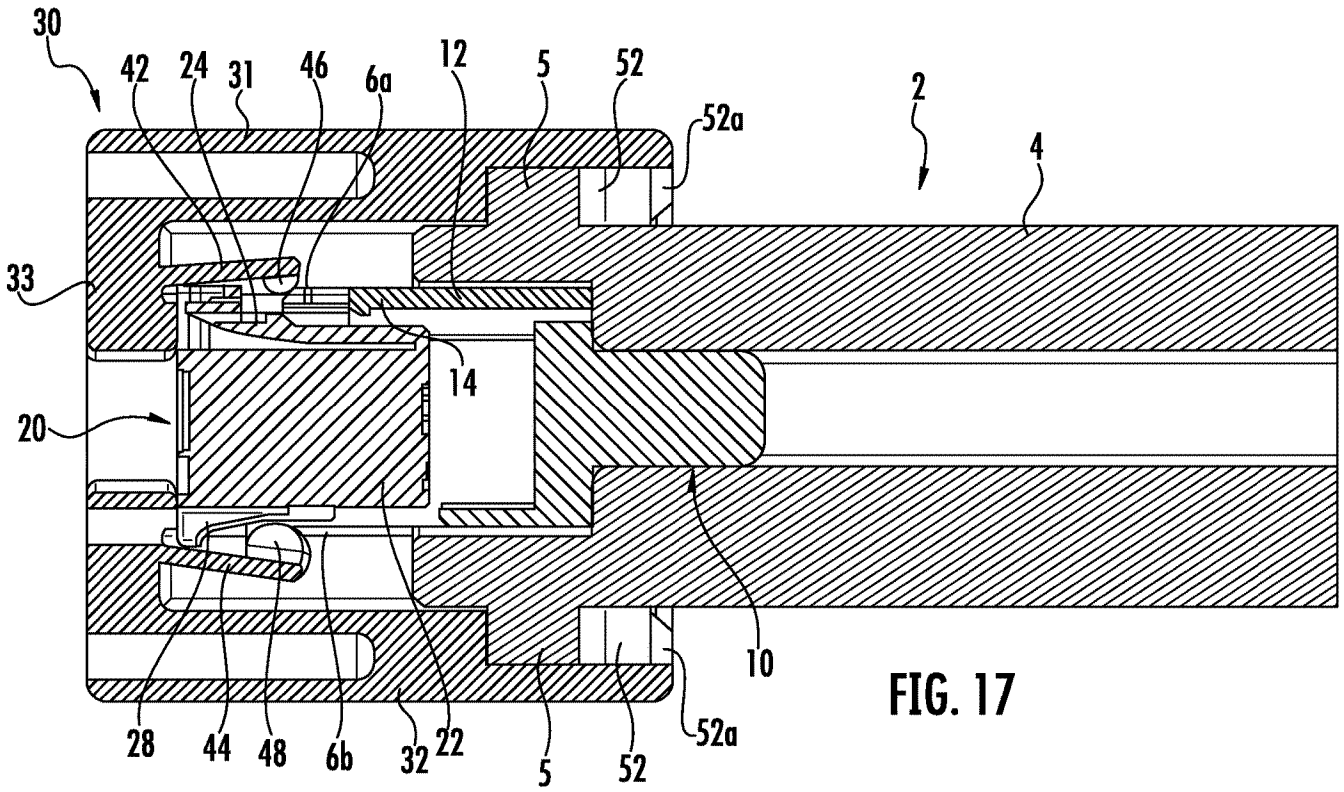
FIG. 17 is a side view in section of the reception end stage.

The receiving groove 52 extends from the edge of the main wall 31, 32 in a receiving direction (direction parallel to the connector connecting direction in this embodiment) having a component of the direction parallel to the connector connecting direction. Thus, the receiving groove 52 enables the engagement of the connector unit 2 and the connector connecting tool 30, as shown in FIGS. 15 to 17, by receiving the guided protrusion 5 being fit in the receiving direction. That is, an upstream end constitutes an inlet end 52*a* open in a direction parallel to the receiving direction on the edge of the main wall 31, 32. The receiving direction may not be a direction completely parallel to the connector connecting direction and may be a direction inclined with respect to the connector connecting direction.

The connection guiding groove 54 is shaped to allow the connector connecting tool 30 to be operated with respect to the connector unit 2 in the tool operating direction parallel to the arrangement direction and to displace the connector connecting tool 30 in the connector connecting direction with respect to the connector unit 2 with the guided protrusion 5 received in the receiving groove 5, i.e. with the guided protrusion 5 inserted to a terminal end of the receiving groove 52. Additionally, the connection guiding groove 54 is shaped to displace the connector connecting tool 30 in the connector connecting direction with respect to the connector unit 2 with a force larger than an operation force received by the connector connecting tool 30 by guiding the guided protrusion 5 in a connection guiding direction inclined toward the connector connecting direction with respect to the tool operating direction as the connector connecting tool 30 is operated. Specifically, the connection guiding groove 54 extends from a back end of the receiving groove 52 opposite to the inlet end 52*a* in a direction intersecting the receiving groove 52, particularly in an oblique direction obtained by combining the arrangement direction and the connector connecting direction. That is, this connection guiding groove 54 cooperates with the guided protrusion 5 to form a force multiplying mechanism for generating a connection force larger than an operation force of the connector connecting tool 30 for displacing the first connector 10 and the second connector 20 in the connector connecting direction as the connector connecting tool 30 is operated.

Here, "extending in an oblique direction" is not intended to limit that the connection guiding groove 54 is straight. This connection guiding groove 54 may be a curved groove displaced in the connector connecting direction with distance from the terminal end of the receiving groove 52.

The separation allowing groove 56 releases the guided protrusion 5 in a separating direction having a component of a direction opposite to the receiving direction (direction opposite to the receiving direction and the connector connecting direction in this embodiment) to allow the guided protrusion 5 to be separated in the separating direction from an end of the connection guiding groove 54 in a state where the connection of the first and second connectors 10, 20 is finished and the guided protrusion 5 has reached the end of the connection guiding groove 54. Specifically, the separation allowing groove 56 extends in the separating direction opposite to the connector connecting direction from the terminal end of the connection guiding groove 54, i.e. an end opposite to the receiving groove, and includes an outlet end 56*a* open in the separating direction on the edge of the main wall 31, 32. The separating direction may not necessarily be completely opposite to the receiving direction and may be inclined with respect to the direction opposite to the connector connecting direction.

According to this electrical connection device, the second connectors 20 can be connected collectively to the first connectors 10 aligned in the connector unit 2, for example, in the following way.

1) Setting of Second Connectors 20 into Connector Connecting Tool 30 (FIGS. 4 to 11)

Figure 6:
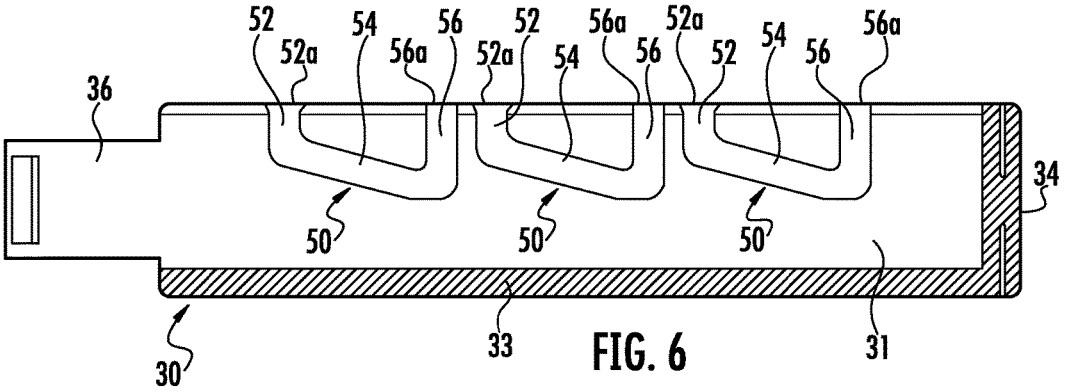
FIG. 6 is a plan view in section along VI-VI of FIG. 4.
Figure 7:
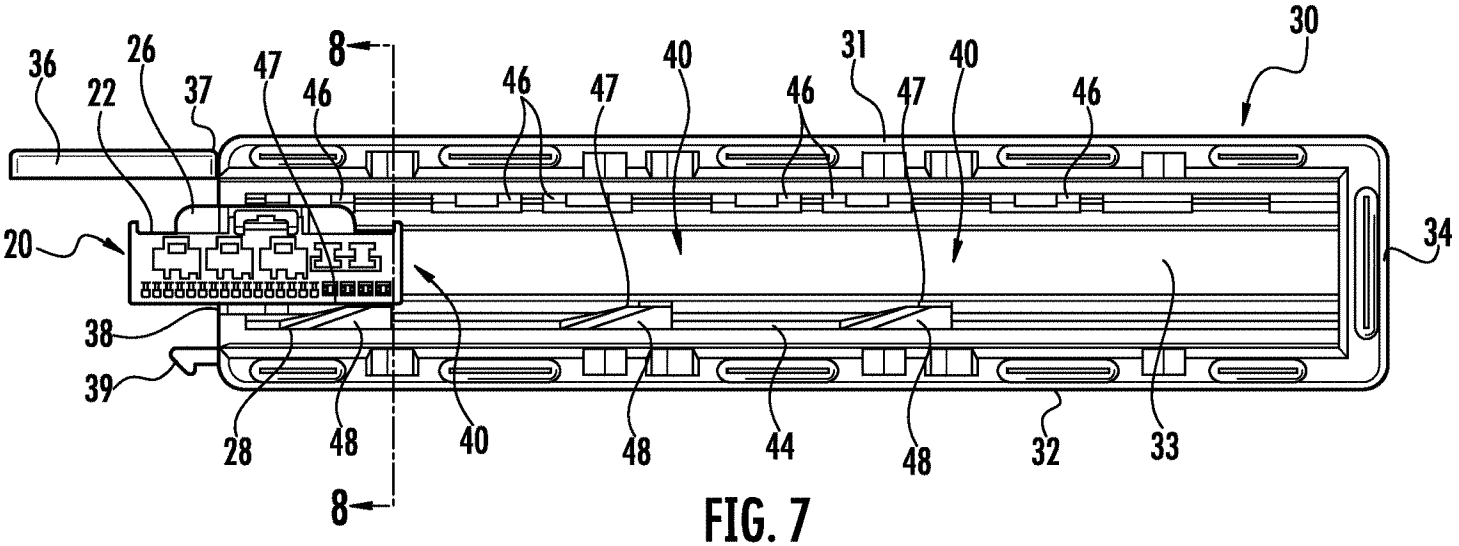
FIG. 7 is a front view showing an initial stage of insertion of the first second connector into the connector connecting tool.

In performing the connection, each second connector 20 is set into the connector connecting tool 30. Specifically, as shown in FIGS. 4 to 6, the second connectors 20 are inserted successively along the arrangement direction through the connector insertion opening 38 with the lid 36 of the connector connecting tool 30 located at the opening position to open the connector insertion opening 38 (FIGS. 7 to 11).

As shown in FIG. 8, each second connector 20 moves over the first upper restraining portions 45 and the lower restraining portion 48 and reaches the connector restraining position 40 therefor while deflecting the upper and lower deflection pieces 42, 44 up and down when the upper and lower protrusions 26, 28 of the second connector 20 contact the first upper restraining portions 45 and the lower restraining portion 48. When each second connector 20 reaches the connector restraining position 40 in this way, the upper and lower deflection pieces 42, 44 resiliently return to initial positions. Thus, the restraining portions 45, 48 return to the restraining positions for restraining each second connector 20 in the arrangement direction. Further, the left and right upper restraining portions 46 at each connector restraining position 40 restrain the second connector 20 to impede the separation of the second connector 20 in a direction away from the back wall 33.

After the insertion of each second connector 20 into the connector connecting tool 30 is completed in this way, the lid 36 is rotated and locked at the closing position, thereby closing the connector insertion opening 38. In this state, the connector connecting tool 30 holds the respective second connectors 20 in an alignment corresponding to that of the respective first connectors 10 in the connector unit 2.

2) Insertion of Guided Protrusion 5 into Each Receiving Groove 52 (FIGS. 12 to 17)

Figure 12:
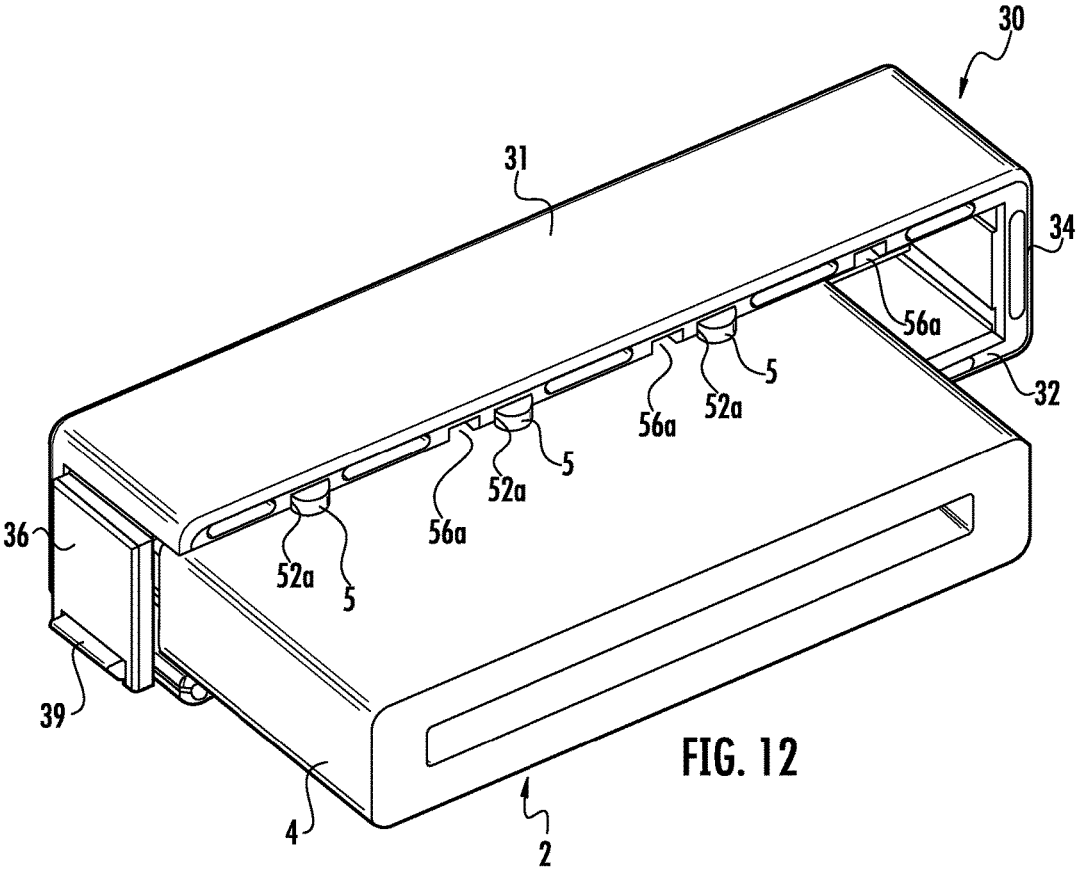
FIG. 12 is a perspective view showing an insertion immediately preceding stage, which is a stage immediately before guided protrusions of the connector unit are inserted into inlet ends of guiding grooves of the connector connecting tool.
Figure 13:
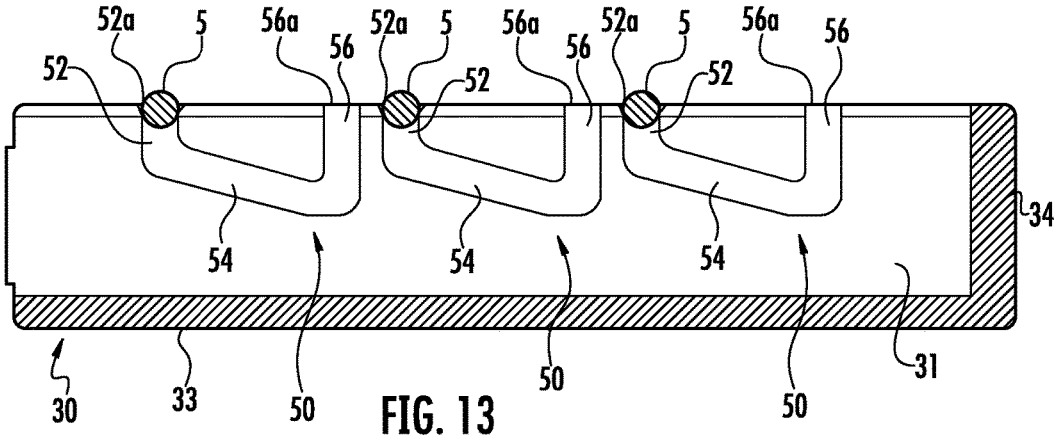
FIG. 13 is a bottom view in section of an upper main wall of the connector connecting tool viewed from below in the insertion immediately preceding stage.
Figure 14:
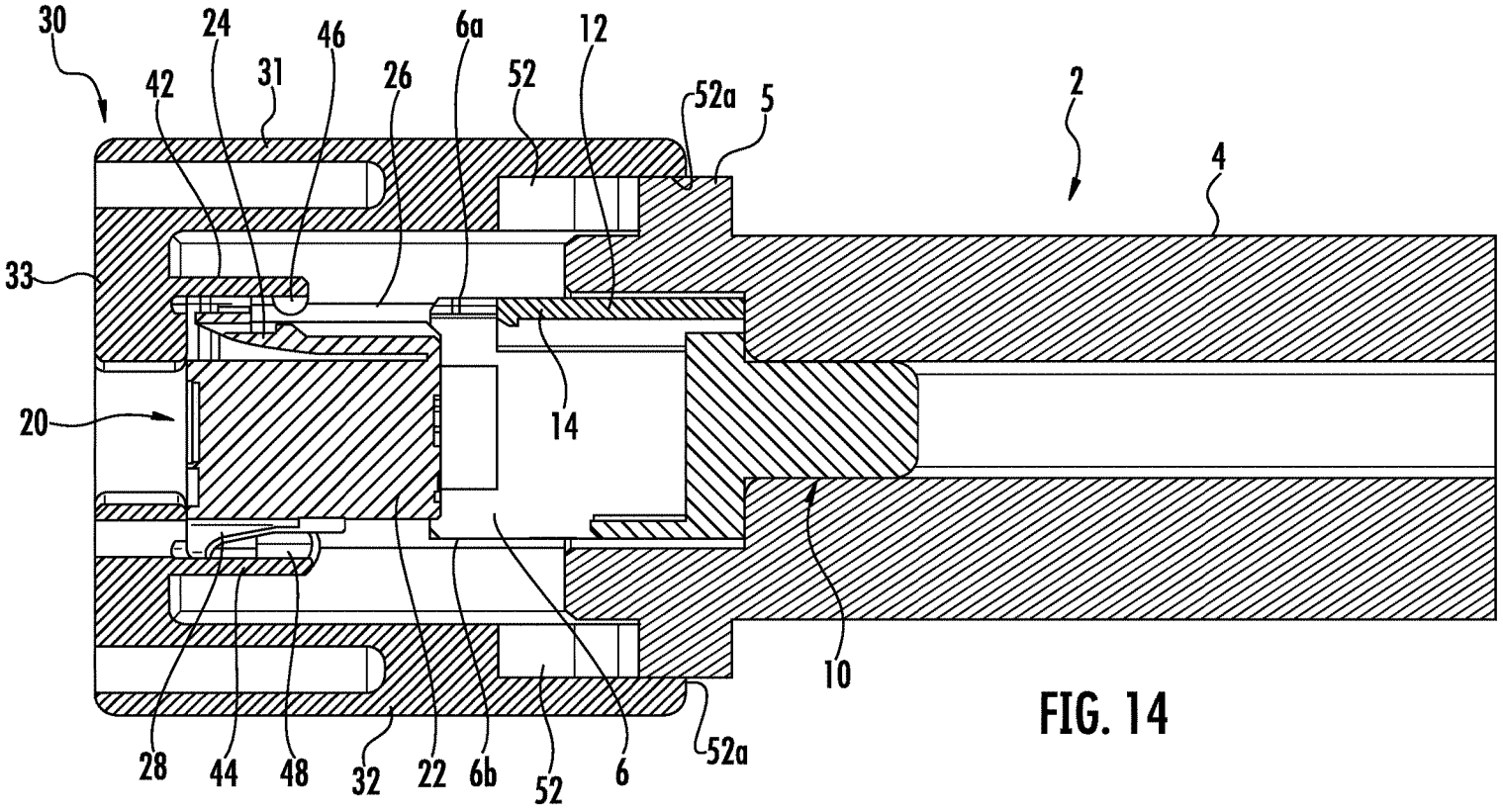
FIG. 14 is a side view in section showing the insertion immediately preceding stage.

The connector connecting tool 30 is mounted to the connector unit 2 such that each guided protrusion 5 of the connector unit 2 is inserted into each receiving groove 52 of the connector connecting tool 30 holding the second connectors 20 as described above. Specifically, as shown in FIGS. 12 to 14, each guided protrusion 5 is fit into the inlet end 52*a* of each receiving groove 52 and the connector connecting tool 30 is operated to move with respect to the connector unit 2 in the receiving direction (direction parallel to the connector connecting direction in this embodiment). This causes each guided protrusion 5 to be inserted to the back end of the receiving groove 52, as shown in FIGS. 15 to 17. In this way, the connector connecting tool 30 and the connector unit 2 are engaged and relative positions of the connector connecting tool 30 and the connector unit 2 are determined by this engagement.

In this embodiment, when the insertion (reception) is completed, the tips of the first connector housings 12 and those of the second connector housings 22 are connected lightly (temporary connection) to determine relative positions of the connector housings 12, 22 in the arrangement direction. On the other hand, upper and lower ends 6*a*, 6*b* of the receptacle 6 of the connector unit 2 respectively contact and press the upper and lower restraining portions 46, 48 up and down so that the upper and lower deflection pieces 42, 44 are deflected up and down to release the restraint of the second connectors 20 by the respective restraining portions 45, 46 and 48. That is, each restraining portion 45, 46, 48 is displaced from the restraining position held thus far to the releasing position.

This release of the restraint may be performed until immediately before a separating operation to be described later and may not necessarily be performed in this stage where the reception is completed.

Figure 18:
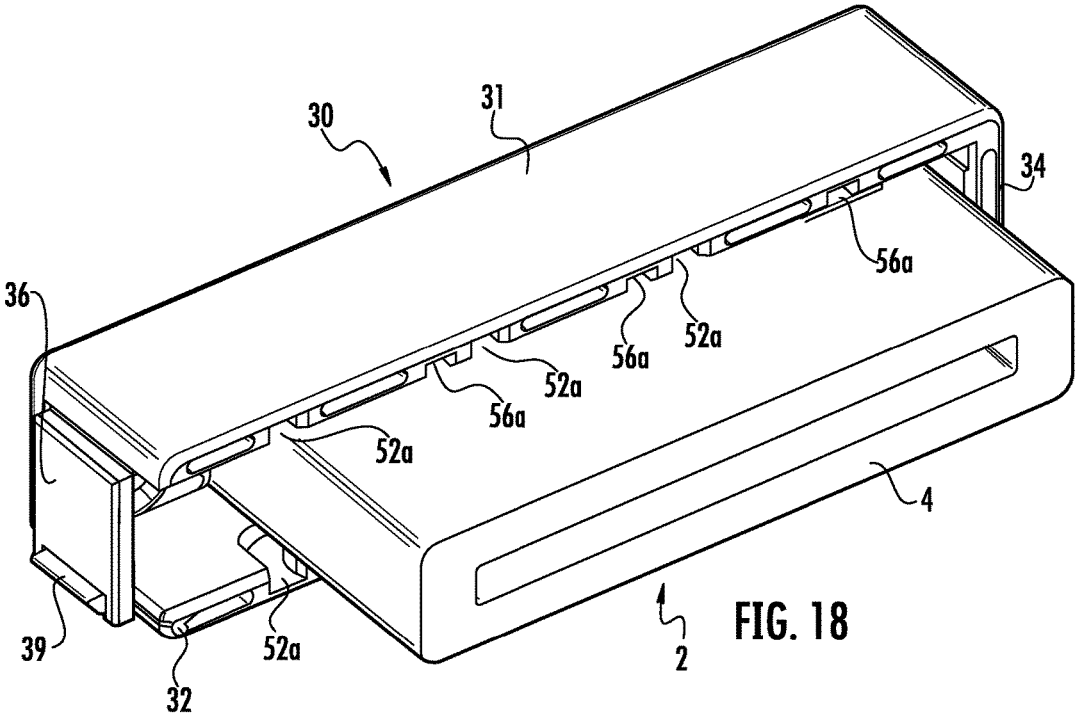
FIG. 18 is a perspective view showing a connection end stage, which is a stage where connector connection by the guiding of the guided protrusions by connection guiding grooves in the guiding grooves is completed.
Figure 19:
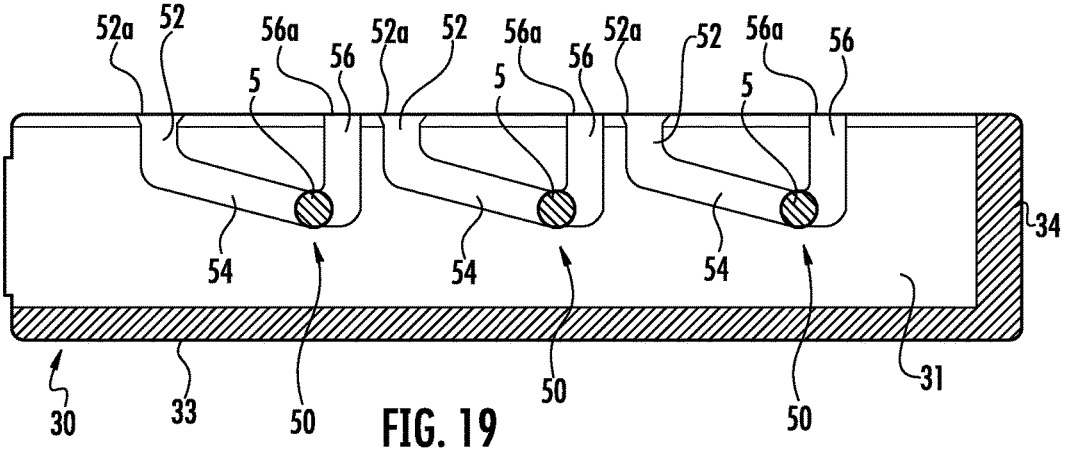
FIG. 19 is a bottom view in section showing the upper main wall of the connector connecting tool viewed from below in the connection end stage.
Figure 20:
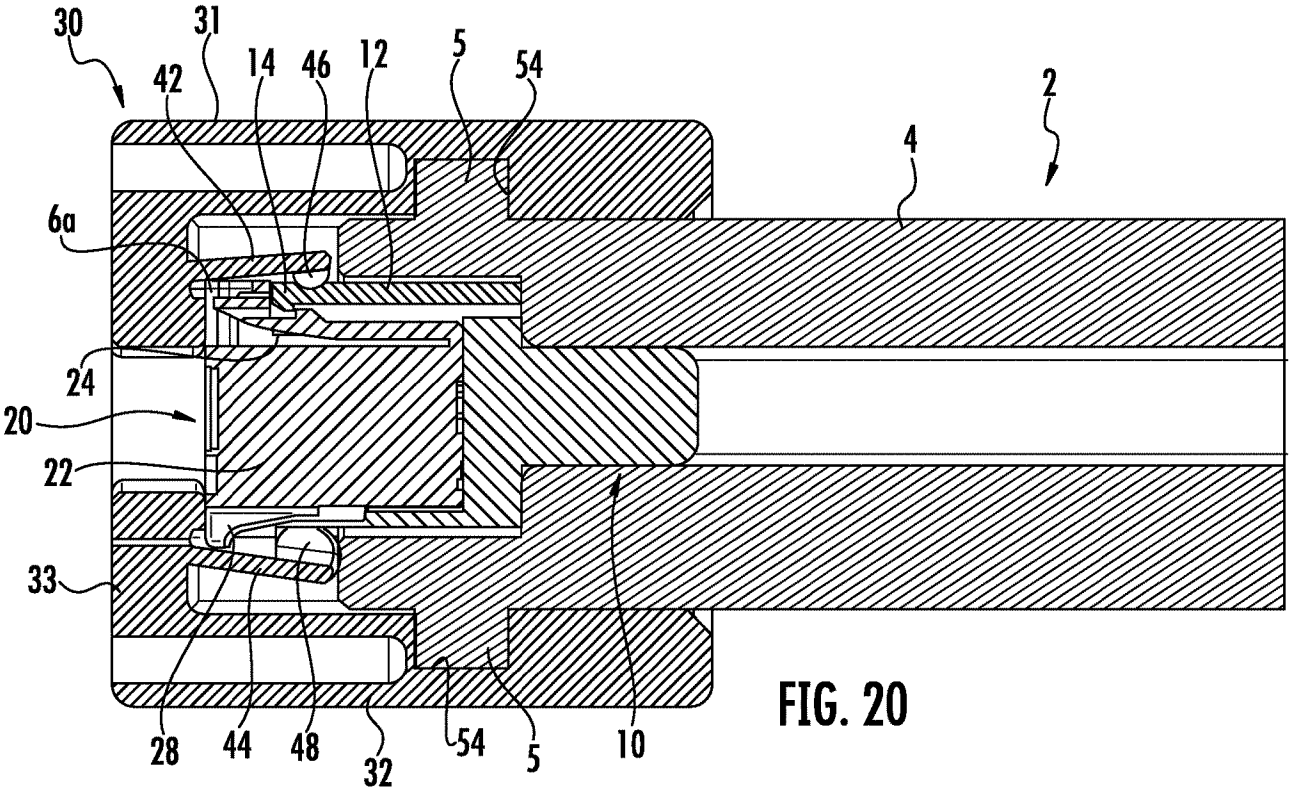
FIG. 20 is a side view in section of the connection end stage.

3) Operation of Connector Connecting Tool 30 in Tool Operating Direction (FIGS. 18 to 20)

The connector connecting tool 30 is operated in the tool operating direction parallel to the arrangement direction with respect to the connector unit 2 from a state where each guided protrusion 5 has reached the terminal end of the receiving groove 52, as described above. Accordingly, each guided protrusion 5 is guided to move along the connection guiding groove 54.

The connection guiding groove 54 extends in the direction obtained by combining the tool operating direction and the connector connecting direction. Thus, the connector connecting tool 30 actually is moved with respect to the connector unit 2 in an oblique direction having a component of the connector connecting direction in addition to a component of the tool operating direction. In this way, the respective second connectors 20 held by the connector connecting tool 30 are moved with respect to the connector unit 2 in the connector connecting direction with a force larger than an operation force given to the connector connecting tool 30, thereby being collectively connected to the respective first connectors 10. In other words, the connector connecting tool 30 enables the first and second connectors 10, 20 to be connected collectively by applying an operation force smaller than a connection force necessary to connect the first and second connectors 10, 20 to the connector connecting tool 30.

Note that the first and second connectors 10, 20 are held connected by the engagement of the connector locks 14, 24 thereof.

Figure 21:
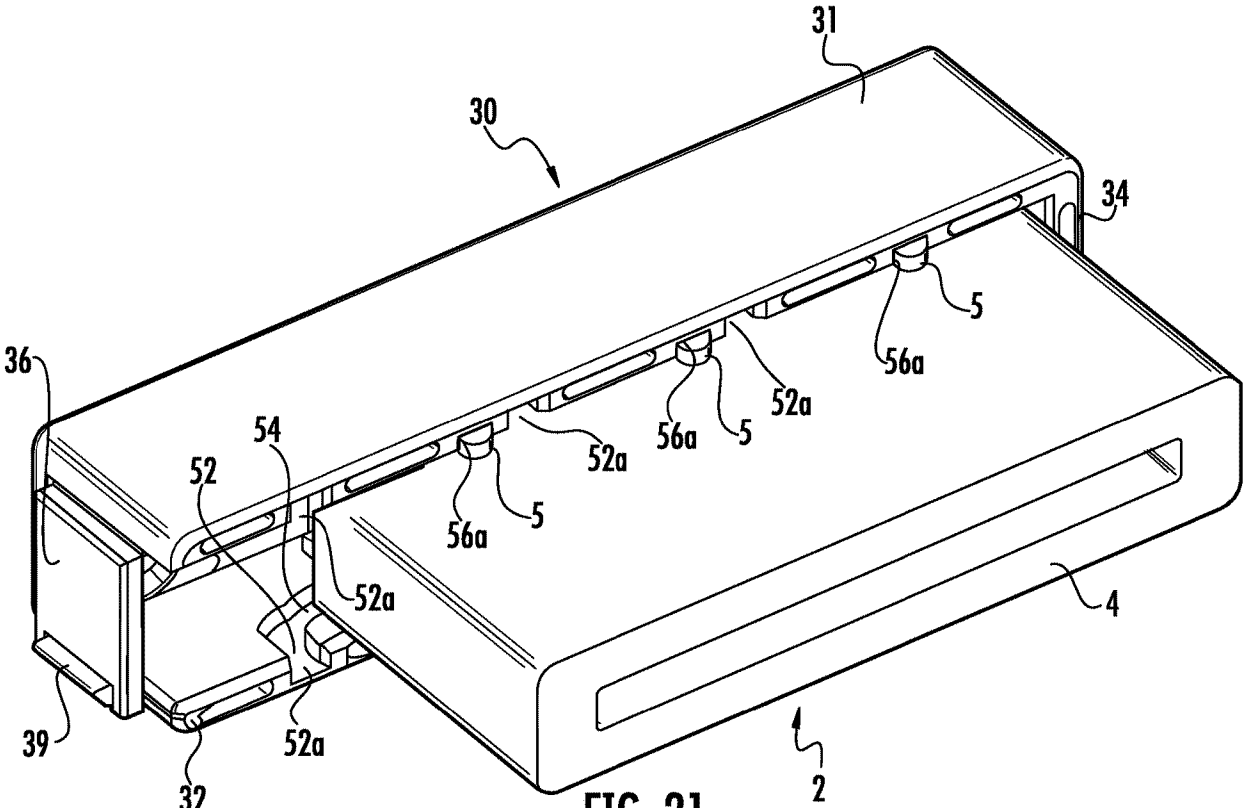
FIG. 21 is a perspective view showing a separation stage, which is a stage where the guided protrusions are separated from the guiding grooves through separation allowing grooves of the guiding grooves.
Figure 22:
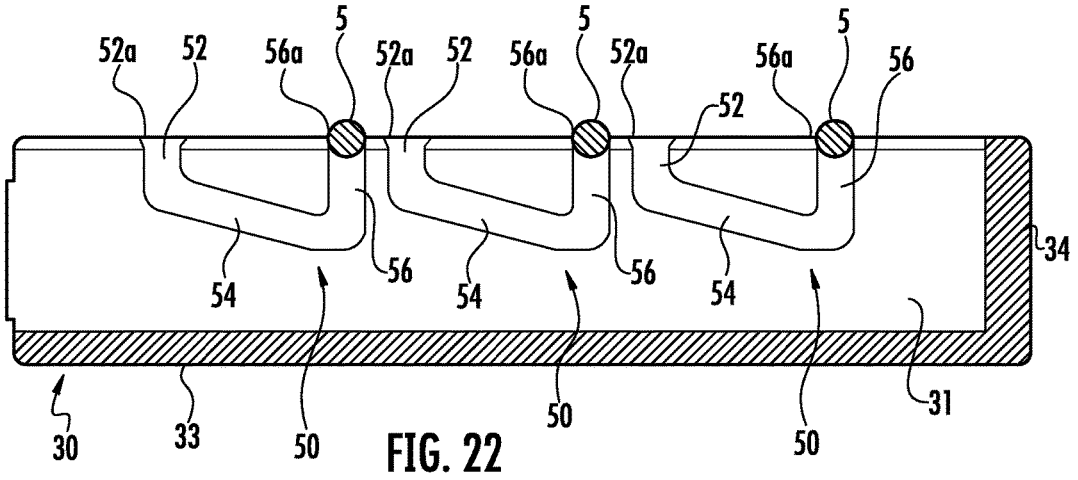
FIG. 22 is a bottom view in section showing the upper main wall of the connector connecting tool viewed from below in the separation stage.
Figure 23:
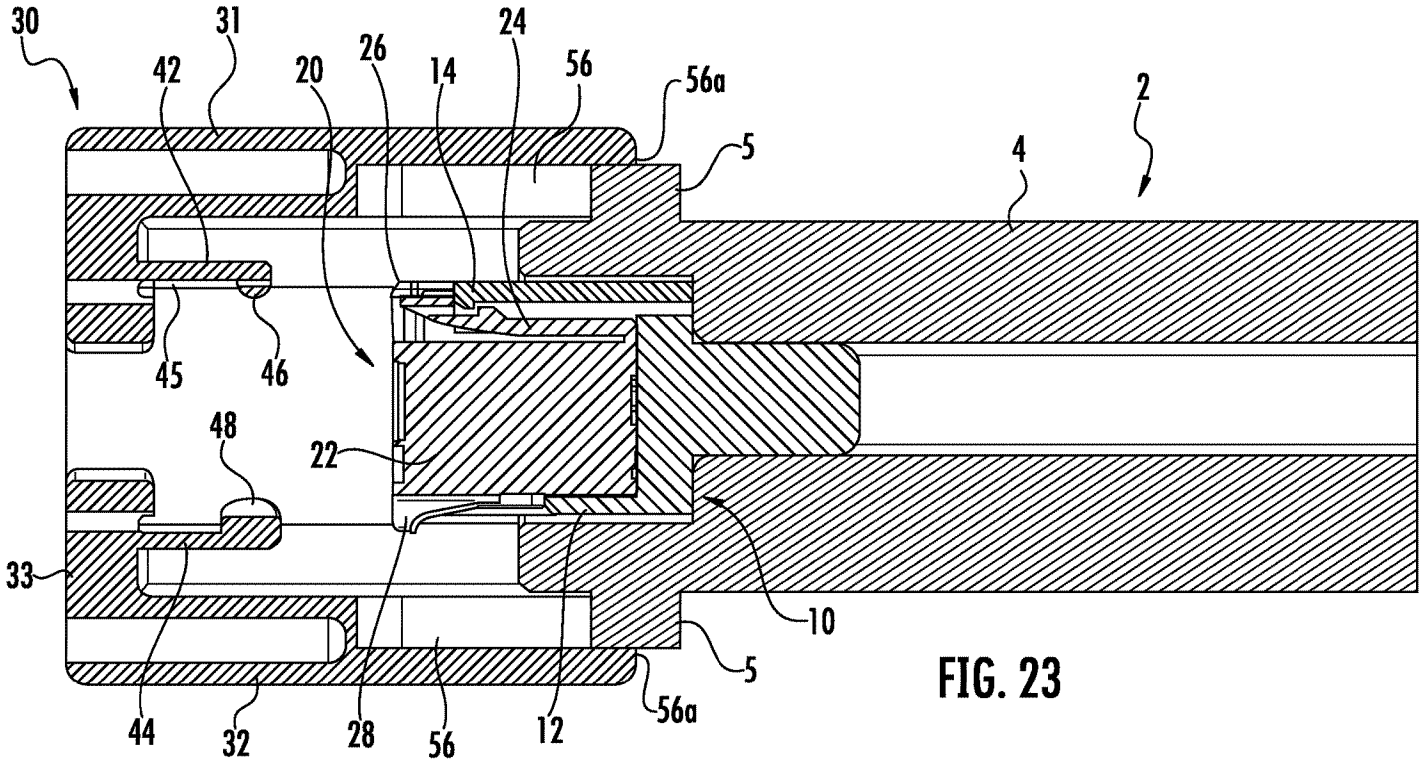
FIG. 23 is a side view in section of the separation stage.

4) Separation of Connector Connecting Tool 30 from Connector Unit 2 (FIGS. 21 to 23)

The guided protrusions 5 that have reached the terminal ends of the connection guiding grooves 54, as described above, can directly enter the separation allowing grooves 56 connected to these terminal ends in the separating direction, thereby being able to be separated from the guiding grooves 50 in the separating direction. In addition, since the restraint of the second connectors 20 by the upper and lower restraining portions 46, 48 already is released as described above at this point in time, the connector connecting tool 30 can be separated from the connector unit 2, leaving the second connectors 20 connected to the respective first connectors 10 in the connector unit 2.

This separation of the connector connecting tool 30 from the connector unit 2 enables the repeated use of the connector connecting tool 30. In addition, the connector connecting tool 30 has a function as a holder for holding the second connectors 20 and a function as an original connecting tool for connecting the first and second connectors 10, 20 by being operated in the tool operating direction with respect to the connector unit 2 while holding the second connectors 20. Thus, the use of a dedicated holder as in conventional devices is unnecessary and the collective connection of a plurality of connectors is realized by a configuration having a small number of components. Further, unlike conventional devices, the connector connecting tool 30 having the holder function is separated from the connector unit 2, and no holder remains between the first and second connectors.

Further, the guided protrusions 5 and the guiding grooves 50 are provided respectively in the connector unit 2 and the connector connecting tool 30. Thus, each second connector 20 need not be provided with a guiding portion or a guided portion, so that versatility is high. Further, after the connection is completed, each second connector 20 can be disconnected individually from the first connector with a small operation force.

The arranged positions and the number of the respective restraining portions 45, 46 and 48 in the connector connecting tool 30 can be set freely according to the number, the shapes and the like of the second connectors 20 to be held by the connector connecting tool 30. Conversely, the versatility of the connector connecting tool 30 can be enhanced by setting the shapes of the second connectors 20 in accordance with the shape of the connector connecting tool 30.

Figure 24:
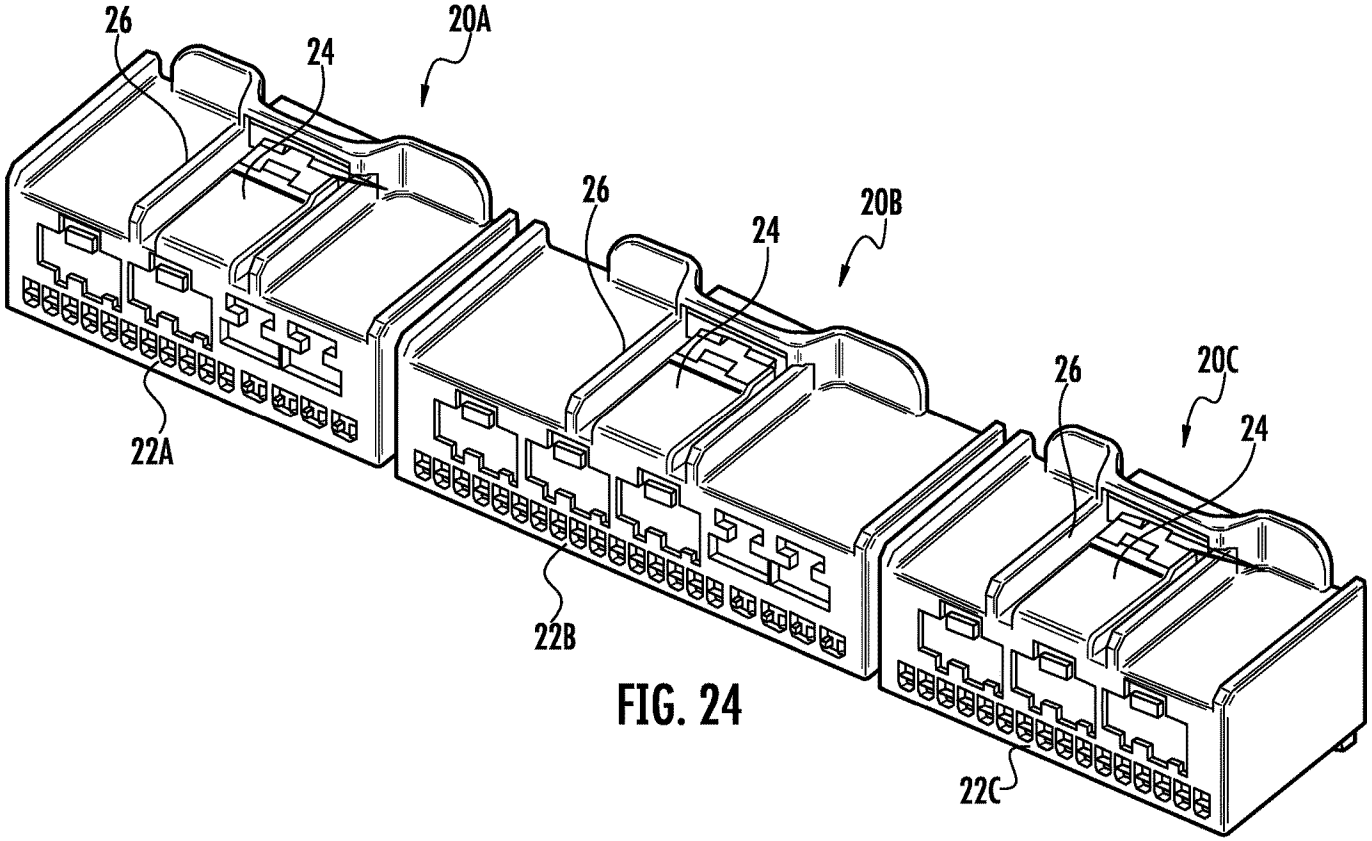
FIG. 24 is a front view showing second connectors according to a modification of the embodiment.
Figure 25:
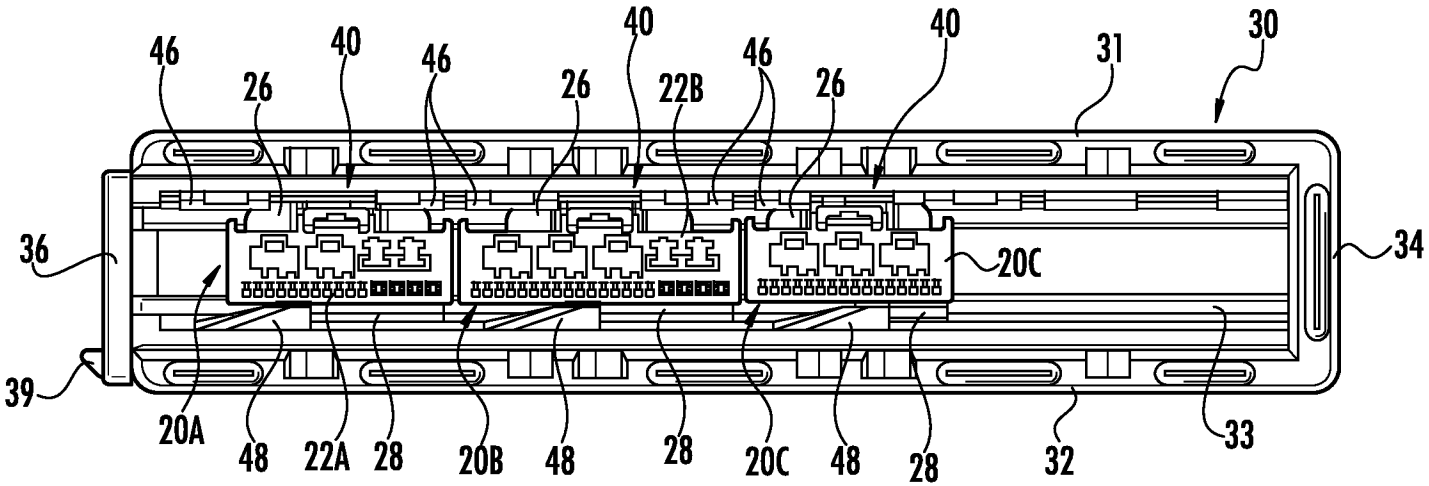
FIG. 25 is a front view showing the second connectors according to the modification and a connector connecting tool for holding these connectors.

For example, the second connectors 20 shown in FIG. 2 have the same shape and the lower restraining portions 48 of the connector connecting tool 30 are arranged at equal intervals. However, the present invention also includes a mode in which second connectors 20A, 20B and 20C having different dimensions in the arrangement direction as shown in FIG. 24 are connected instead of the second connectors 20. Also in this mode, the connector connecting tool 30 shown in FIGS. 3 to 11 can hold not only the second connectors 20, but also the second connectors 20A to 20C, as shown FIG. 25 by setting the positions of upper protrusions 26 and lower protrusions 28 on the respective second connectors 20A to 20C in accordance with the restraining portions 45, 46 and 48 regardless of the dimensions in the arrangement direction.

Besides, the present invention can include, for example, the following modes.

A) Concerning Holding of Second Connectors by Connector Connecting Tool

A specific structure for holding the second connectors by the connector connecting tool can be set as appropriate. The connector connecting tool may, for example, receive the second connectors inserted therein not in the arrangement direction, but in a direction parallel to the connector connecting direction.

B) Concerning Release of Restraint of Second Connectors in Connector Connecting Tool In the above embodiment, the upper and lower ends 6*a*, 6*b* of the receptacle 6 of the connector unit 2 respectively release the restraint of the second connectors 20 by the upper and lower restraining portions 46, 48, thereby enabling the connector connecting tool 30 to be separated from the second connectors 20. However, this separation may be released manually. Further, it is sufficient to release the restraint of the second connectors in the separating direction and, for example, the restraint in the arrangement direction (restraint by the first upper restraining portions 45 and the lower restraining portions 48 in the above embodiment) may not necessarily be released.

C) Concerning Guiding Portion and Guided Portion

The guiding portion and the guided portion according to the present invention are not limited to the guiding grooves 50 and the guided protrusions 5. For example, the guided portion may be a ridge having a guiding surface configured to contact the guided portion only from one side.

In the present invention, the guiding groove 50 may be provided in the connector unit and the guided protrusion 5 may be provided in the connector connecting tool. Also in this case, the first connectors and the second connectors can be connected with a small connection force by relatively displacing the connector unit and the connector connecting tool in the connector connecting direction by the guided portion being guided by the guiding portion as the connector connecting tool is operated with respect to the connector unit.

The numbers of the guiding portions and the guided portions can also be freely set. By providing the guiding portions and the guided portions at positions arranged in the direction parallel to the arrangement direction as in the above embodiment, the connector unit and the connector connecting tool can be displaced in the connecting direction with a stable guiding force even if there are many first connectors and second connectors.

As described above, an electrical connection device is provided with a small number of components and in which connectors can be collectively connected with a small operation force.

This electrical connection device includes a connector unit including first connectors aligned along a specific arrangement direction, second connectors respectively connectable to the first connectors in a connector connecting direction perpendicular to the arrangement direction, and a connector connecting tool for connecting the first connectors and the respective second connectors. The connector connecting tool detachably holds the second connectors in an alignment corresponding to that of the first connectors so that the first connectors and the second connectors are connectable. One of the connector unit and the connector connecting tool includes a guided portion, and the other includes a guiding portion for guiding the guided portion while being engaged with the guided portion. The guiding portion includes a receiving portion for enabling the engagement of the connector unit and the connector connecting tool by receiving the guided portion in a receiving direction having a component of a direction parallel to the connector connecting direction. A connection guiding portion allows the connector connecting tool to be operated in a tool operating direction parallel to the arrangement direction with respect to the connector unit with the guided portion received in the receiving portion. Thus, the guided portion is guided in a connection guiding direction inclined toward the connector connecting direction with respect to a direction parallel to the tool operating direction to displace the connector connecting tool in the connector connecting direction with respect to the connector unit with a force larger than an operation force received by the connector connecting tool as the connector connecting tool is operated. A separation allowing portion is provided for releasing the guided portion in a separating direction having a component of a direction opposite to the receiving direction to allow the guided portion to be separated from the connection guiding portion in the separating direction after the connection.

Here, a "direction having a component of a direction parallel to the connector connecting direction" may be any of a direction parallel to the connector connecting direction and a direction inclined with respect to the connector connecting direction. A "separating direction having a component of a direction opposite to the receiving direction" may be any of a direction completely opposite to the receiving direction and a direction inclined with respect to a direction opposite to the connector connecting direction.

According to the above electrical connection device, the first connectors and the second connectors can be connected with a small operation force by the use of the connector connecting tool. Specifically, by operating the connector connecting tool in the tool operating direction in a state where the connector connecting tool holds the second connectors in the predetermined alignment and the guided portion is received into the receiving portion of the guiding portion and engaged with the guiding portion, the connection guiding portion of the guiding portion guides the guided portion so that the first connectors and the second connectors are connected. The separation allowing portion allows the guided portion to be separated from the connection guiding portion after the connection is finished. Thus, the connector connecting tool can be separated from the connector unit merely by releasing the holding of the second connectors by the connector connecting tool.

The connector connecting tool of this electrical connection device has both a function as a holder for holding the second connectors and a function as a connecting tool for connecting the first and second connectors by being operated in the tool operating direction with respect to the connector unit while holding the second connectors. The connector connecting tool is displaced in the connector connecting direction with respect to the connector unit the guided portion guided by the guiding portion according to the operation in the tool operating direction, thereby connecting the first and second connectors. Thus, unlike conventional devices, a holder for holding the second connectors is not required separately from the connector connecting tool. Therefore, the collective connection of the first and second connectors is realized by a configuration having a small number of components. Further, since it is not necessary to provide each second connector with the guiding portion or the guided portion, versatility is high. Furthermore, since the connector connecting tool can be separated from the connector unit by the separation allowing portion allowing the separation of the guided portion after the connection is completed, an interposed component such as a holder does not remain between the first connectors and the second connectors. Further, each of the second connectors can be disconnected individually from the first connector with a small operation force.

The restraint of the second connectors by the connector connecting tool may be released manually to enable the separation of the connector connecting tool from the connector unit, but it is more preferable to automatically release the restraint as the connection of the first and second connectors is completed. Specifically, the connector connecting tool includes a connector restraining portion for restraining the second connectors to impede displacements of the second connectors in a direction corresponding to the separating direction. The connector restraining portion is displaceable from a restraining position for restraining the second connectors to a releasing position for releasing the restraint as being resiliently deformed. The connector unit includes a restraint releasing portion for releasing the restraint of the second connectors by the connector restraining portion to enable the separation of the connector connecting tool from the second connectors in the separating direction by operating the connector restraining portion to displace the connector restraining portion to the releasing position as the connection of the first connectors and the second connectors proceeds. This restraint releasing portion eliminates the need for a special operation to release the restraint of the second connectors by a user.

The shape and structure of the connector connecting tool can be set as appropriate. For example, the connector connecting tool preferably includes two main walls located on both sides across the second connectors in a direction perpendicular to both the connector connecting direction and the tool operating direction. Each main wall extends in a direction parallel to the arrangement direction. A coupling wall couples end parts of the main walls excluding end parts on the side of the connector unit and end parts in the arrangement direction. A connector insertion opening is formed between the one end parts, and is shaped to receive the second connectors successively inserted along the arrangement direction between the main walls through the connector insertion opening. This shape facilitates an operation of setting each second connector into the connector connecting tool.

Further, if the connector connecting tool is resiliently deformable such that the pair of main walls are displaced in directions away from each other, each second connector can be inserted more easily between the main walls, utilizing these displacements.

The guiding portion and the guided portion to be engaged with the guiding portion may be provided at each of plural positions arranged in a direction parallel to the arrangement direction. These guiding portions and guided portions can relatively displace the connector unit and the connector connecting tool in the connector connecting direction with a stable guiding force even if there are many first connectors and second connectors.

The guided portion preferably is a guided protrusion projecting in a direction perpendicular to the connector connecting direction and the tool operating direction, and the guiding portion preferably is a guiding groove for allowing the guided portion to be fit therein. In this case, the receiving portion preferably is a receiving groove extending in the connector connecting direction and having one end constituting an inlet end open in a direction parallel to the connector fitting direction. The connection guiding portion preferably is a connection guiding groove extending in a direction having a component of the arrangement direction and a component of the connector connecting direction from a back end of the receiving groove opposite to the inlet end, and the separation allowing portion preferably is a separation allowing groove extending in a direction opposite to the connector connecting direction from a terminal end of the connection guiding groove opposite to the receiving groove and having an outlet end open in the direction opposite to the connector connecting direction.

The invention claimed is:

1. An electrical connection device, comprising:

a connector unit including first connectors aligned along a specific arrangement direction;

second connectors respectively connectable to the first connectors in a connector connecting direction perpendicular to the arrangement direction; and a connector connecting tool for connecting the respective first and second connectors;

the connector connecting tool detachably holding the second connectors in an alignment corresponding to that of the first connectors so that the first connectors and the second connectors are connectable;

one of the connector unit and the connector connecting tool including a guided portion, and the other including a guiding portion for guiding the guided portion while being engaged with the guided portion;

the guiding portion including a receiving portion for enabling the engagement of the connector unit and the connector connecting tool by receiving the guided portion in a receiving direction having a component of a direction parallel to the connector connecting direction, a connection guiding portion for allowing the connector connecting tool to be operated in a tool operating direction parallel to the arrangement direction with respect to the connector unit with the guided portion received in the receiving portion and guiding the guided portion in a connection guiding direction inclined toward the connector connecting direction with respect to a direction parallel to the tool operating direction to displace the connector connecting tool in the connector connecting direction with respect to the connector unit with a force larger than an operation force received by the connector connecting tool as the connector connecting tool is operated, and a separation allowing portion for releasing the guided portion in a separating direction having a component of a direction opposite to the receiving direction to allow the guided portion to be separated from the connection guiding portion in the separating direction after the connection.

2. The electrical connection device of claim 1, wherein the connector connecting tool includes a connector restraining portion for restraining the second connectors to impede displacements of the second connectors in a direction corresponding to the separating direction, the connector restraining portion being displaceable from a restraining position for restraining the second connectors to a releasing position for releasing the restraint as being resiliently deformed, and the connector unit includes a restraint releasing portion for releasing the restraint of the second connectors by the connector restraining portion to enable the separation of the connector connecting tool from the second connectors in the separating direction by operating the connector restraining portion to displace the connector restraining portion to the releasing position as the connection of the first and the second connectors proceeds.

3. The electrical connection device of claim 1, wherein the connector connecting tool includes two main walls located on both sides across the second connectors in a direction perpendicular to both the connector connecting direction and the tool operating direction, each main wall extending in a direction parallel to the arrangement direction, and a coupling wall coupling end parts of the main walls excluding end parts on the side of the connector unit and ones of both end parts in the arrangement direction, a connector insertion opening being formed between the one end parts, and is shaped to receive the second connectors successively inserted along the arrangement direction between the main walls through the connector insertion opening.

4. The electrical connection device of claim 3, wherein the connector connecting tool is resiliently deformable such that the main walls are displaced in directions away from each other.

5. The electrical connection device of claim 1, wherein the guiding portion and the guided portion to be engaged with the guiding portion are provided at each of a plurality of positions arranged in a direction parallel to the arrangement direction.

6. The electrical connection device of claim 1, wherein the guided portion is a guided protrusion projecting in a direction perpendicular to the connector connecting direction and the tool operating direction, and the guiding portion is a guiding groove for allowing the guided portion to be fit therein.

7. The electrical connection device of claim 6, wherein the receiving portion is a receiving groove extending in the connector connecting direction and having one end constituting an inlet end open in a direction parallel to the connector connecting direction, the connection guiding portion is a connection guiding groove extending in a direction having a component of the arrangement direction and a component of the connector connecting direction from a back end of the receiving groove opposite to the inlet end, and the separation allowing portion is a separation allowing groove extending in a direction opposite to the connector connecting direction from a terminal end of the connection guiding groove opposite to the receiving groove, and having an outlet end open in the direction opposite to the connector connecting direction.

* * * * *